US005628412A

United States Patent [19]

Hulls

[11] Patent Number: 5,628,412

[45] Date of Patent: May 13, 1997

[54] METHOD OF WASTE RECYCLING

[75] Inventor: John R. Hulls, Point Reyes, Calif.

[73] Assignee: Altamont, Inc., Key Biscayne, Fla.

[21] Appl. No.: 344,814

[22] Filed: Nov. 23, 1994

[51] Int. Cl.[6] ..... B07C 7/04

[52] U.S. Cl. ..... 209/702; 209/930

[58] Field of Search ..... 209/702, 930

[56] References Cited

U.S. PATENT DOCUMENTS

| | | | |
|---|---|---|---|
| 2,980,314 | 4/1961 | Adams . | |
| 3,349,991 | 10/1967 | Kessler . | |
| 4,747,701 | 5/1988 | Perkins . | |
| 4,913,560 | 4/1990 | Herrington . | |
| 4,949,528 | 8/1990 | Palik | 209/930 X |
| 4,953,704 | 9/1990 | Cortese . | |
| 4,978,231 | 12/1990 | Ling et al. . | |
| 4,989,994 | 2/1991 | Gelbard . | |
| 5,028,022 | 7/1991 | Metcalf . | |
| 5,040,902 | 8/1991 | Eaton et al. . | |
| 5,072,833 | 12/1991 | Hansen et al. | 209/930 X |
| 5,100,005 | 3/1992 | Noble et al. | 209/930 X |
| 5,133,607 | 7/1992 | Bonke . | |
| 5,169,588 | 12/1992 | Estepp | 209/930 X |
| 5,251,761 | 10/1993 | Hansen et al. | 209/930 X |
| 5,299,693 | 4/1994 | Ubaldi et al. | 209/930 X |
| 5,425,456 | 6/1995 | Erickson | 209/930 X |

*Primary Examiner*—D. Glenn Dayoan

*Attorney, Agent, or Firm*—Majestic, Parsons, Siebert & Hsue

[57] ABSTRACT

A method of recycling employs a plurality of bags for containing and transporting recyclable that can survive the compaction process without breaking and mixing their contents. The inventive method includes the steps of: compacting recyclable that have been segregated into bags; transporting the bags to a transfer station; and separating the bags into groups of material containing like classifications. Thereafter, the classified recyclable material is either recycled into reusable material or transported to storage or to a recycling plant where the material is recycled into reusable material. The method may also include the preliminary step of separating the recyclable into a plurality of bags prior to placing the bags into a compactor vehicle or, as an interim step, into a garbage container, with or without other non-recyclable waste material. The separating may be done by visually perceptible coding on the bags, or by scanning coding on or in the bags by using a scanning device. Alternatively, a single bag containing recyclable may be used rather than multiple bags containing different classifications of recyclable.

25 Claims, 2 Drawing Sheets

METHOD OF WASTE RECYCLING

BACKGROUND OF THE INVENTION

Currently, recycling programs are being politically mandated as environmentally sound. Much recyclable waste, such as household waste products, is being collected. Some comes from single-family homes. Other waste, a significant amount of about forty-two percent, is being generated in high-rise buildings.

The most basic form of recycling involves separation of recyclable from non-recyclable at a transfer station. Recyclable may be metal, glass, plastic, paper, or other materials that can be reused. Typically, the homeowner or high-rise dweller just throws the recyclable mixed with other organic material, etc. in a garbage can or chute (high-rise). The contents of the garbage can are then loaded into a garbage truck, usually with compaction capability. In the high-rise building, the garbage may be collected in large bins, which are then loaded into the compaction truck. The compacted waste, including both recyclable and non-recyclable, is then transported to a transfer station.

At the transfer station, the trucks are unloaded and the waste, including recyclable, is spread out for sorting. By various means, the recyclable are removed, categorized, and placed into intermediate storage areas or bins. For example, aluminum, which currently is in the greatest demand, is placed in one storage location. Other metals are placed in another. Glass is placed in another, and plastic is placed in yet another. Paper is placed in another. What remains of the waste after removal of recyclable is then loaded onto transfer vehicles such as on-highway trucks for transport to landfill facilities. Alternatively, trains may be used to transport the waste where longer distances to the landfill are involved.

A problem with the just-described system is that the recyclable are contaminated by the other components of the raw garbage. This may lower the value of the recyclable, as some must be discarded, and others cleaned prior to re-use.

Another problem is that of high cost. This cost is both in terms of labor and equipment. Complex equipment is needed to sort the recyclable from the rest of the waste. Such equipment may include electromagnetic means for separating the ferrous metal from non-ferrous metal, such as aluminum. Regardless of the amount of equipment used, expensive hand labor ultimately must be resorted to for a portion of the recyclable.

Still another problem is that of the working environment for the hand labor. At the very best, it is unpleasant. At worst, it can be hazardous to worker health and well-being.

In an attempt to ameliorate some of these problems, advances in recycling have been made. One such advance is the so-called "Blue Bag" program that has been used in Pittsburgh and other United States East Coast cities. With this system, the consumer places the recyclable in a separate plastic bag of a blue color. The bags are very thick and the recyclable can only be compacted to about a 2:1 ratio as opposed to about 6:1 that can be achieved with conventional garbage compaction trucks. This system has a cost disadvantage, since more trucks or runs are needed for pickup than with other systems. Also, it is easy for operators to overcompact, which results in breaking of the bags and consequent undesired mixing of the contents with the raw garbage, thus destroying or substantially reducing its value as a recyclable.

Another such advance is to provide the consumer with several containers in addition to the normal garbage can or bin so that the customer may do the initial separation and classification of the recyclable. One such system provides three stacking box containers of plastic material. These are for: (1) aluminum and plastic; (2) glass; and (3) paper (e.g., newspaper). With this system, a special collection truck having three bins on a side arrives before or follows after the normal garbage truck. The individual boxes are hand dumped into the appropriate bin on the side of the recyclable collection truck, and the truck driven to a transfer station where it is unloaded into appropriate storage bins or areas as with the previous system.

This advanced system, which is coming into increasing use, has its problems. It is still costly. Now a second truck is required, which essentially doubles the vehicles and personnel required for collection from the customer.

It is also inefficient in that many recyclable collection trucks do not have compactor capability. Thus, recyclable trucks are less densely loaded than normal garbage compactor vehicles.

It may also be less convenient to the customer where the boxes are required to be taken out to the curb rather than being picked up at the side or back of the customer's house, as with some waste pickup systems. As with anything placed at the curb, the boxes may invite theft or vandalism. Theft of the valuable recyclable, such as aluminum, can severely negatively impact the economics of recycling programs. The initial negative economic impact is on the collection company. This later transfers through to the customer in that the loss is reflected in higher garbage collection bills.

Aesthetically, the boxes at the curb are considered unsightly by some. They must also be placed at the curb on the appropriate day and retrieved after the collection truck has passed. If the homeowner plans to be away, the boxes may have to be put out a day or more early, or the pickup simply missed. If missed, more than one collection period worth of recyclable will have to be stored by the customer until the next pickup. All of these problems make the customer less likely to be a willing participant in recycling.

Still another problem being encountered with any recycling system is selling the collected recyclable. There may, in fact, be no spot market for certain recyclable at a given time. Or the spot market price may be too low to be economic. This gives rise to the need to be able to store classified recyclable until the market can achieve a high enough price that selling the recyclable makes economic sense.

Another problem is the need to be able to collect and store a sufficient quantity of recyclable to make it economically worthwhile to build necessary reclamation plants. With plastic, for example, it is desirable to have up to four year's worth of recycled plastic on hand to make it worthwhile to build such a plant. Obviously, this necessitates a great deal of storage space.

Still another problem is being able to identify the classified recycled material so that automated equipment can be used in processing.

SUMMARY OF THE INVENTION

The present invention takes the form of a method for recycling that solves the above-enumerated problems. The method utilizes a bag that can survive the compaction process. Several such bags would be provided to the customer and would be color-coded for various categories of recyclable, e.g. plastic, glass, paper, metal, etc.

The bag could be made of double-walled plastic material having folds or gussets therein. The folds or gussets would allow the bag to be expanded from a smaller initial volume wherein it closely fits within a supporting container to a larger expanded bag which is less than completely full. Holes that do not match up in both bags would allow the escape of air. Alternatively, the bags could just be made of plastic material of sufficient shear strength as to not rupture during compaction. That is, bags other than the kind that are the subject of the referenced co-pending application could be used with the instant method. Not filling the bags completely full would also assist in preventing rupture during compaction.

The bags of either form could be color-coded so that their contents could be visually known. Alternatively, color-coded tags mounted on elastic bands could be fastened over the ends of the bags. In addition, other indicia means that could be read by automated scanning means might be used. Such could be impregnated magnetic coding, bar coding, or the like.

A key feature of this method is that it permits the recyclable material to be kept in a single bag container that is loaded by the customer from the beginning and when it goes into storage or is used. There is no labor-intensive transfer from container to container as the recyclable material goes through the process. This also permits the bags containing recyclable to be put in the normal garbage container with all of the other waste. No separate pickup is required. The recyclable within their bags simply go into the normal garbage container. This eliminates the necessity of a separate pickup for recyclable. This also avoids major contamination from the other garbage.

BRIEF DESCRIPTION OF THE DRAWINGS

The above and other features and aspects of the present invention will become more apparent upon the reading of the following detailed description in conjunction with the accompanying drawings, in which.

DETAILED DESCRIPTION OF THE PREFERRED EMBODIMENT

Figure 1:
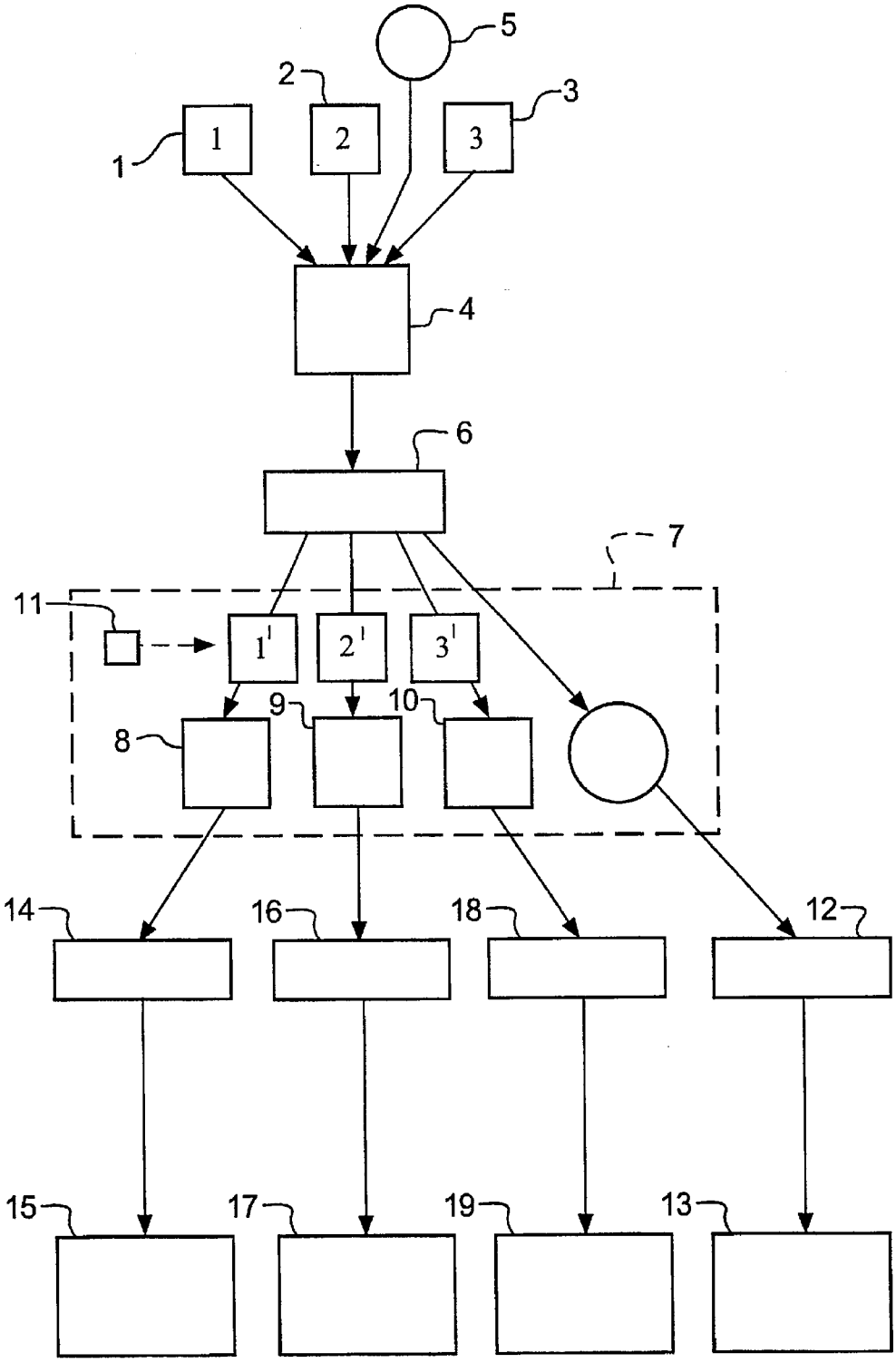
FIG. 1 is a diagrammatic depiction of the preferred method of the present invention illustrating the steps thereof; and, FIG. 2 is a diagrammatic depiction of an alternate method of the present invention also illustrating the steps thereof.

FIG. 1 is a diagrammatic view of the method steps of the present invention showing three bags 1, 2, and 3, by way of example. It should be understood that two or more bags may be used with the preferred embodiment of the present invention. Also, while the term "bag" is used in this description, it is to be understood that such is merely for convenience and is not to be taken as limiting. Any suitable container may be used in place of the bag for purposes of this invention.

Each bag may be made of any suitable material that will contain waste and not rupture during the compaction process. A suitable material may be plastic of sufficient shear strength to stretch during compaction while maintaining the integrity of the bag. Examples of such materials are polyethylene or polyurethane. Alternatively, the bag may be one that has folds or pleats so as to be expandable from a smaller to a larger initial volume, as aforementioned.

Recyclable are classified and placed in the appropriate bag. In the example shown, plastic could be placed in bag 1, aluminum in bag 2, and newspaper in bag 3. On garbage pickup day, the bags are closed by any convenient means, such as ties, wires, etc. and are placed into a garbage can 4 or other bin or container. Of course, the bags could be placed in the garbage can as they are filled, and not just on the pickup day.

Other non-recyclable waste 5 is also typically placed in the container. This raw garbage or waste that would otherwise contaminate the recyclable is prevented from doing so by the bags. The garbage can contents are dumped into a compactor vehicle 6, and compacted to a lesser volume. After this, the compactor vehicle moves to different pickup points and repeats the process of collecting waste from other garbage cans.

The compactor vehicle then moves to a transfer station 7, where the contents of the vehicle are dumped. The bags are then identified by coding means and separated into groups according to the kind of recyclable contained therein. As shown, they may be placed in separate bins 8, 9, and 10, respectively. These storage bins are used to collect a sufficient quantity of classified waste for further processing.

Parenthetically, the coding of the bags can also identify other things, such as where the bags came from. This could be down to the level of the home or apartment house. Cities or other governmental units where recyclable originate could also be identified. In this manner, the originator of the recyclable might be given some credit, such as monetary compensation, for the value of the recyclable. This compensation could be credited even years later after the bag had been retrieved from long-term storage.

The identification of the bags may be done manually, as in an operator viewing a color-coded bag or tag. Alternatively, a scanning means 11 may be used and the bags passed by the scanning means or vice versa. A control means actuated by the scanning means may be used to move bags to the appropriate storage bin by means of conveyors, cranes or grapples (not shown).

At the same time that the bags are being sorted by their contents, the non-recyclable waste that remains can be placed in transfer trailers such as trailer 12, and taken to a dump site such as a sanitary landfill 13, and dumped and covered over with earth.

The recyclable can be treated in several different ways. For example, the bags containing plastic material in bin 8 can be loaded into a transfer trailer 14 and taken to a remote location 15, where the trailer is unloaded. The bags containing plastic may be allowed to accumulate until there is sufficient quantity to support building a plastic reduction plant. After such "mouth of the mine" plant is built, the by-then very large supply of stored bags of plastic will serve as the raw material for the plant.

Similarly, bags containing aluminum material in bin 9 may be loaded into a transfer trailer 16 and transported to an aluminum recycling plant 17 where the aluminum may be reclaimed. Since aluminum is in great demand, this transfer to a recycling plant can take place without storage, although storage until the spot market is at a higher rate is certainly an alternative.

Finally, newspaper from bin 10 may be treated in a similar manner. It can be directly loaded into a transfer trailer 18 or other means of transport and moved to a pulp plant where the newspaper is recycled into, e.g. newsprint. Alternatively, the bags of newspaper could be stored until the spot market price is deemed right for sale before transporting the newspaper to be recycled.

It should be understood that with any material, either temporary storage at the transfer station or long-term storage at a location away from the transfer station may be an alternative to taking the material in bags directly to a recycling plant from the transfer station.

The basic waste handling method comprises the steps of: compacting recyclable that have been segregated into bags; transporting the bags to a transfer station; and separating the bags into groups of material containing like classifications. Thereafter, bags containing like classifications of recyclable material may either be transported to storage or to a recycling plant where the material is recycled into reusable material. The method may also include the step of separating the recyclable into a preliminary plurality of bags prior to placing the bags into a compactor vehicle or, as an interim step, into a garbage container, with or without other non-recyclable waste material. The separating may be done by visually perceptible coding on the bags or by scanning coding means on the bags by using a scanning means.

Figure 2:
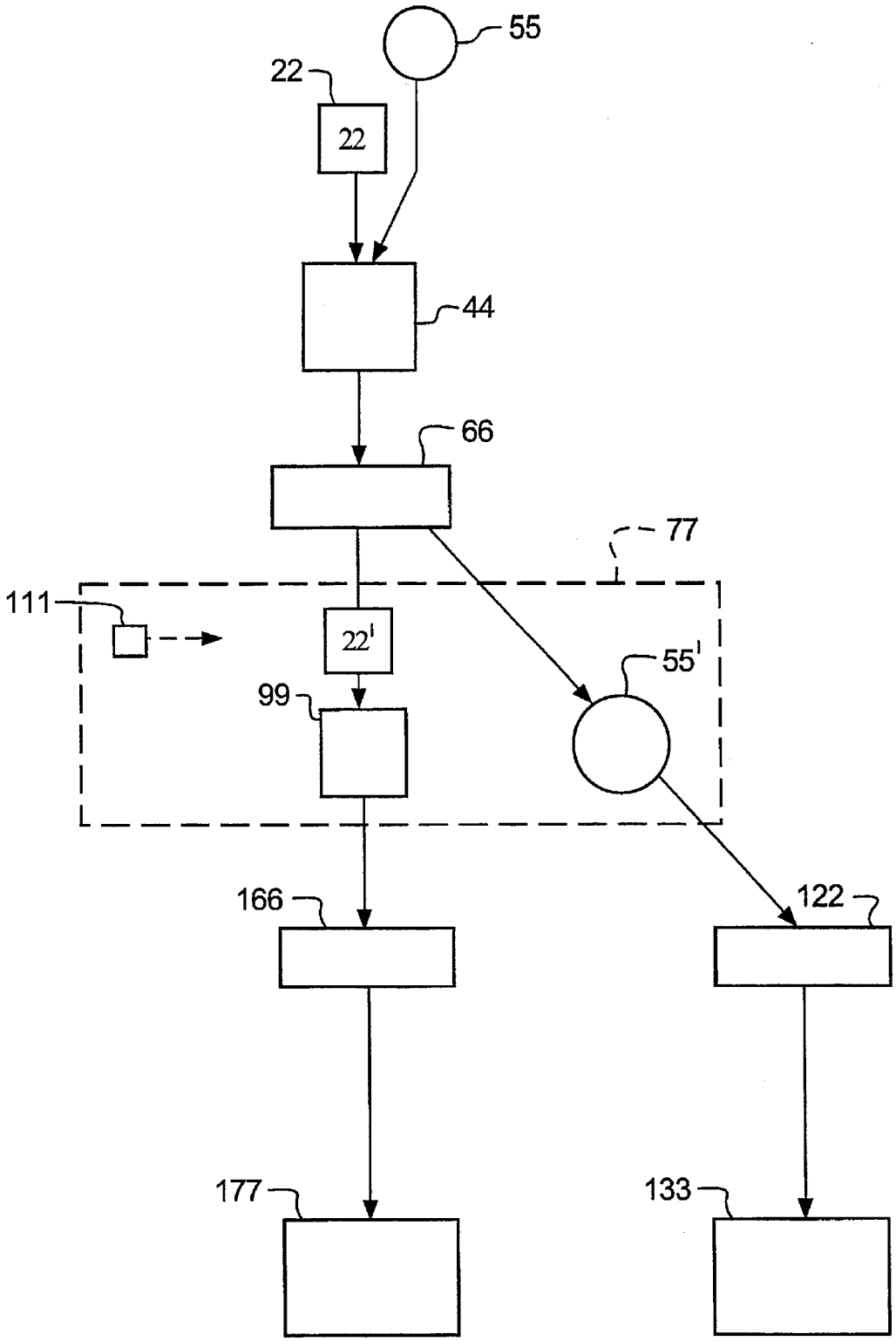

A still further alternative is to use a single bag rather than multiple bags for the recyclable. With this alternative, as seen in FIG. 2, the above method steps are modified on the preliminary end by placing all classes of recyclable in a single bag 22 before placing the bag into a compactor vehicle 66 or, as an interim step, into a garbage container 44, with or without other non-recyclable waste material 55.

With this alternate method the compactor vehicle moves to a transfer station 77. Rather than the bags 22, being separated, they may be scanned for a purpose previously described by scanner 111, or simply not scanned at all. They are then placed in a bin 99 after being separated from the raw garbage or waste 55.

Thereafter, the recyclable material in bags may be loaded into a transfer trailer 166 and transported to a recycling plant 177, where the material is classified and reclaimed. Alternatively, some or all classifications of material may be stored in the bags and accumulated until a later time. The raw garbage or waste may be loaded in a transfer trailer 122 and transported to a sanitary landfill site 133 for disposal as with the multiple bag system of the preferred method.

While the preferred embodiment and an alternate illustrating the implementation of the method has been disclosed, it will be understood that the invention is not specifically limited thereto, but is to be determined by the scope of the appended claims.

What is claimed is:

1. A waste handling method comprising the steps of:

(a) separating recyclables into a plurality of bags with recyclables of a particular classification being placed in each bag, each said bag having coding means so that the contents of said bags can be identified;

(b) placing said bags in a container;

(c) transferring the bags to a compactor vehicle having compacting means thereon;

(d) compacting said bags into compacted bags within said compactor vehicle so that they take up less space;

(e) transporting said compacted bags to a transfer station in said compactor vehicle;

(f) unloading said compacted bags from said compactor vehicle;

(g) separating said bags into groups, each of the groups containing like classifications of recyclables, by using the coding means;

(h) placing bags from a group into a transfer trailer;

(i) transporting said bags from a group to a disposal site away from said transfer station in said transfer trailer;

(j) unloading said bags from a group into an area; and (k) repeating the steps (a) through (j) until a desired quantity of bags from a group have been accumulated.

2. The waste handling method of claims 1 including the further steps of:

(a) placing the bags from a group into a transfer trailer; and (b) transporting said bags from a group to a means for recycling the contents of said bags from a group into reusable material.

3. The waste handling method of claim 1 wherein the step of placing said bags in a container further includes the step of placing other material in said container.

4. The waste handling method of claim 1 wherein said bags are made of a material of sufficient shear strength so that it is capable of retaining its structural integrity and not rupturing throughout the compaction step.

5. The waste handling method of claim 1 wherein said coding means utilizes colors to provide a visual indication for identification purposes.

6. The waste handling method of claim 5 wherein said coding means comprises a colored tag attached to each of said bags.

7. The waste handling method of claim 1 wherein said coding means comprises indicia on each of said bags which are visually readable.

8. The waste handling method of claim 1 wherein said coding means comprises indicia means on each of said bags which are readable by a scanning means.

9. The waste handling method of claim 8 wherein said indicia means are bar codes and said scanning means comprise a bar code reader.

10. The waste handling method of claim 8 wherein said indicia means are electronically readable.

11. The waste handling method of claim 8 wherein the step of separating comprises scanning said bags by means of said scanning means, identifying bags as being from particular groups, and segregating bags by group.

12. A waste handling method comprising the steps of:

(a) placing recyclables into at least one bag;

(b) placing said at least one bag in a container;

(c) transferring said at least one bag to a compactor vehicle having compacting means thereon;

(d) compacting said at least one bag within said compactor vehicle so that it takes up less space;

(e) transporting said at least one compacted bag to a transfer station in said compactor vehicle;

(f) unloading said at least one compacted bag from said compactor vehicle;

(g) placing said at least one bag into a transport means;

(h) transporting said at least one bag to a disposal site away from said transfer station by said transport means;

(i) unloading said at least one bag into an area; and (j) repeating the steps (a) through (i) until a desired quantity of bags have been accumulated.

13. The waste handling method of claim 12 including the further steps of:

(a) placing the bags into a transport means; and (b) transporting said bags to a means for recycling the contents of said bags into reusable material.

14. The waste handling method of claim 12 wherein the step of placing said at least one bag in a container further includes the step of placing other material in said container.

15. The waste handling method of claim 12 wherein said bags are made of a material of sufficient shear strength so that they are capable of retaining their structural integrity and not rupturing throughout the compaction step.

16. The waste handling method of claim 12 further including coding means on said at least one bag for purposes of identification.

17. The waste handling method of claim 16 wherein said coding means utilizes colors to provide a visual indication for identification purposes.

18. The waste handling method of claim 17 wherein said coding means comprises a colored tag attached to each of said at least one bag.

19. The waste handling method of claim 12 wherein said coding means comprises indicia on each of said at least one bag which are visually readable.

20. The waste handling method of claim 12 wherein said coding means comprises indicia means on said at least one bag which are readable by a scanning means.

21. The waste handling method of claim 20 wherein said indicia means are bar codes and said scanning means comprise a bar code reader.

22. The waste handling method of claim 20 wherein said indicia means are electronically readable.

23. The waste handling method of claim 12 including the step of coding said at least one bag to identify the originator and giving credit, such as monetary compensation, to the originator.

24. The method of claim 23 wherein the credit is given after a period of time.

25. The method of claim 23 wherein the credit is given after said at least one bag is retrieved from storage.

* * * * *